United States Patent [19]

Kane

[11] 4,004,304

[45] Jan. 25, 1977

[54] BOX SPRING ASSEMBLY

[75] Inventor: Walter Harold Kane, Auburn, Mass.

[73] Assignee: Webster Spring Co. Inc., Oxford, Mass.

[22] Filed: Dec. 15, 1975

[21] Appl. No.: 640,751

[52] U.S. Cl. ..... 5/267; 5/256

[51] Int. Cl.[2] ..... A47C 23/02

[58] Field of Search ..... 5/257, 266, 267, 351

[56] References Cited

UNITED STATES PATENTS

| | | | |
|---|---|---|---|
| 3,662,411 | 5/1972 | Garceau | 5/266 |
| 3,789,440 | 2/1974 | Garceau | 5/267 |
| 3,833,949 | 9/1974 | Piliero | 5/267 |
| 3,864,765 | 2/1975 | Anonauer | 5/267 |

*Primary Examiner*—Casmir A. Nunberg
*Attorney, Agent, or Firm*—Robert T. Gammons

[57] ABSTRACT

A spring assembly comprising, spaced pairs of crossing wires welded at their intersections such as to form a dimensionally stable structure wherein the pairs of crossing wires define seats for attachment thereto of the end loops of coiled springs, characterized in that at least two of the wires of the seats are spaced apart a distance less than the distance of the diameter of the end loops and contain deviations perpendicular to the plane of the structure providing longitudinal downwardly facing openings and an upwardly facing opening between the downwardly facing openings and wherein the end loops have arcuate portions which pass through the downwardly facing openings from the inner side outwardly and deviating portions which pass through the upwardly facing openings from the outer side inwardly and wherein the distance between the deviating portions and the end loops is less than the distance between the wires.

8 Claims, 8 Drawing Figures

BOX SPRING ASSEMBLY

BACKGROUND OF INVENTION

Most spring assemblies are constructed by attaching wires longitudinally and transversely to a border wire and then attaching the coils to the wires with their axes perpendicular to the plane of the wires. The coils are attached by twisting portions of the end loops of the coils about the wires, or by twisting portions of the wires about the end loops, or by using separate clamps to attach the end loops to the wires and/or by using locking wires. In all such structures the attachment requires the use of special tools and is a manual operation which requires considerable time, is tedious, difficult and must be preformed at the place of manufacture. Recently Applicant developed a snap-on spring assembly which is the subject matter of U.S. Pat. No. 3,662,411, which eliminated for the most part the foregoing problems. This was achieved by providing deviations in the end loops of the coils and also in the wires which could be interengaged by deformation and become locked to each other by allowing the parts to return to their initial configuration. In the patent the wires were provided with downwardly depressed portions and the end loops of the coils with inwardly bent portions, the end loops were placed against the undersides of the wires and the inwardly bent portions spread apart to clear the wires and then allowed to retract inwardly thru the downwardly depressed portions of the wires. This was the first structure of the kind wherein the composite parts could be shipped from the place of manufacture to the customer unassembled and assembled by the customer without need for special tools and/or skilled assistance. A variation of this was patented by Reupel U.S. Pat. No. 3,766,578 wherein deviations in the form of hooks were made in the opposed wires at the seats and the end loops of the coils were deformed sufficiently to clear the hooks so as to allow the hooks to be entered into the open ends of the coils whereupon the end loops were released and became locked to the wires. This constituted a second way of providing for a snap-on assembly of the coils to the grid. In each instance the construction constituted an advance in the art and enabled manufacture and shipping of the parts to the customer for assembly thus making tremendous savings in shipping and assembly costs. This invention is a further improvement in that it provides for a snap-on structure which is more stable in that when attached, rocking and twisting of the coils relative to the wires will be substantially eliminated. This is done by increasing the interlocking surfaces and the angular disposition of the parts so as to resist relative movement.

SUMMARY OF INVENTION

As herein illustrated the invention resides in a spring assembly comprising a border wire to which are attached transversely and longitudinally extending pairs of crossing wires welded at their intersections, said pairs of crossing wires defining seats for attachment thereto of the end loops of coil springs, characterized in that at least two opposed wires of the seats contain deviations and the end loops contain diametrically opposed deviations of such configuration as to require relative deformation of the wires and end loops to be interengaged and to become locked by restoration to their undeformed state and wherein the deviations in the end loops lie in the plane of the end loops and the deviations in the wires lie in planes perpendicular thereto such that arcuate portions of the wires of the end loops pass thru the deviations of the wires from the inside to the outside and the deviating portions of the end loops pass back thru the deviations in the wires from the outside to the inside, the arcuate portions passing thru from the inside passing beneath the deviating portions of the wires so as to prevent movement upwardly relative to the plane of the wires, the deviations of the end loops passing thru from the outside passing above the undeviated portions of the wires so as to prevent movement downwardly relative to the plane of the wires, and the deviation in the wires preventing lateral movement of the deviations in the end loops in either direction. The distance between the wires containing the deviations is less than the diameters of the end loops and the distance between the deviating portions of the loops is less than the distance between the wires. The displacment of the deviating portions of the wires is upwardly with respect to the plane of the wires and corresponds substantially to the thickness of the end loops and are longitudinally spaced defining in a plane perpendicular to the plane of the wires, two downwardly facing openings and an upwardly facing opening between the downwardly facing openings. The wires in one direction lie in a plane above the wires in the other direction and the deviations in the wires in the one direction lie in a plane above the wires in the other direction.

The invention will now be described in greater detail in reference to the accompanying drawings wherein.

Figure 1:
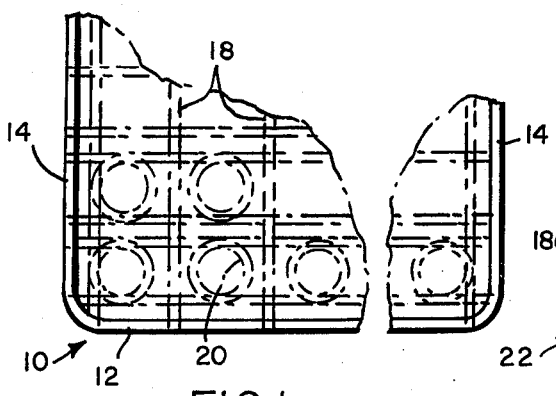
FIG. 1 is a fragmentary plan view of the spring structure such as may be used for making box springs for beds or furniture showing pairs of crossing longitudinally and transversely extending spaced parallel wires the ends of which are attached to a border wire and coil springs attached thereto.

Referring to the drawings, FIG. 1, the spring assembly comprises a frame of rectangular configuration made up of a border wire 10 having spaced parallel sides 12—12 and spaced parallel ends 14—14 to which are attached longitudinally and transversely extending pairs of crossing wires 16 and 18 and coil springs 20 attached at one end to the wires.

Figure 2:
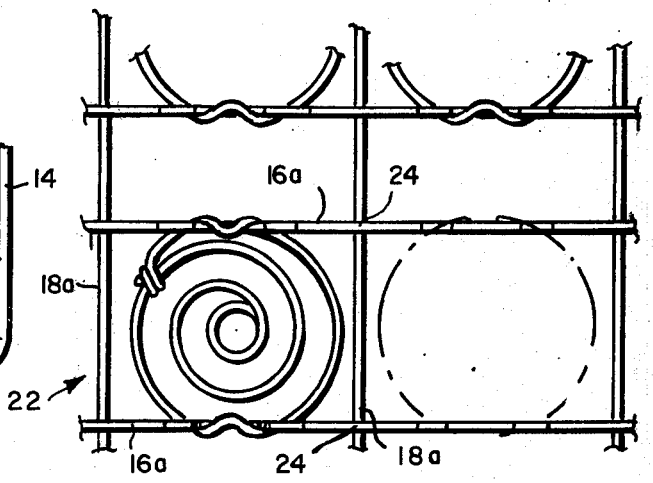
FIG. 2 is a plan view to much larger scale of the structure shown in FIG. 1 showing the manner in which the coils are attached.

As shown in FIG. 2, the crossing pairs of wires 16 and 18 are welded at their intersections 24 to provide a dimensionally stable structure. The pairs of crossing wires provide substantially rectangular seats 22 for the end loops of the coils to be attached thereto, each end seat being defined by spaced parallel wire sections 16$^a$—16$^a$ and 18$^a$—18$^a$. As herein shown the distance between the wire sections 18$^a$—18$^a$ is greater than the diameter of the end loops of the coils and the distance between the wire sections 16$^a$—16$^a$ is less than the diameter of the end loops of the coils. The latter wire sections $16^a$—$16^a$ in accordance with this invention are provided with longitudinally spaced upwardly bent portions $16^b$—$16^b$ which are substantially rectangular in configuration and which rise above the undepressed or displaced portion of the wire $16^a$ a distance corresponding substantially to the diameter of the wires of the end loops of the coils. As thus formed the upwardly displaced portions are situated in a plane perpendicular to the plane of the end loops of the coil springs and define downwardly facing openings $16^c$—$16^c$ and an upwardly facing opening $16^d$. The wires $16^a$ are welded to the upper sides of the wires $18^a$.

Figure 3:
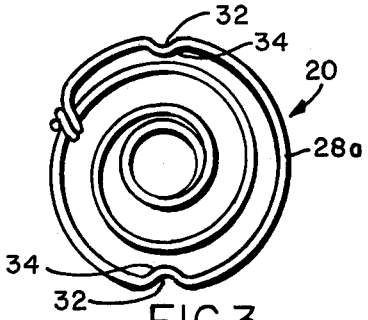
FIG. 3 is a plan view of the upper end of a coiled spring showing the top loop.
Figure 4:
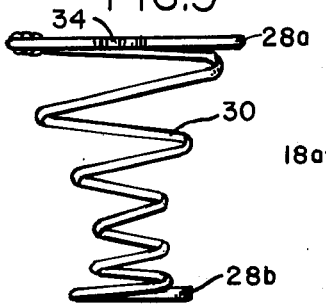
FIG. 4 is an elevation of the coil spring shown in FIG. 3.
Figure 5:
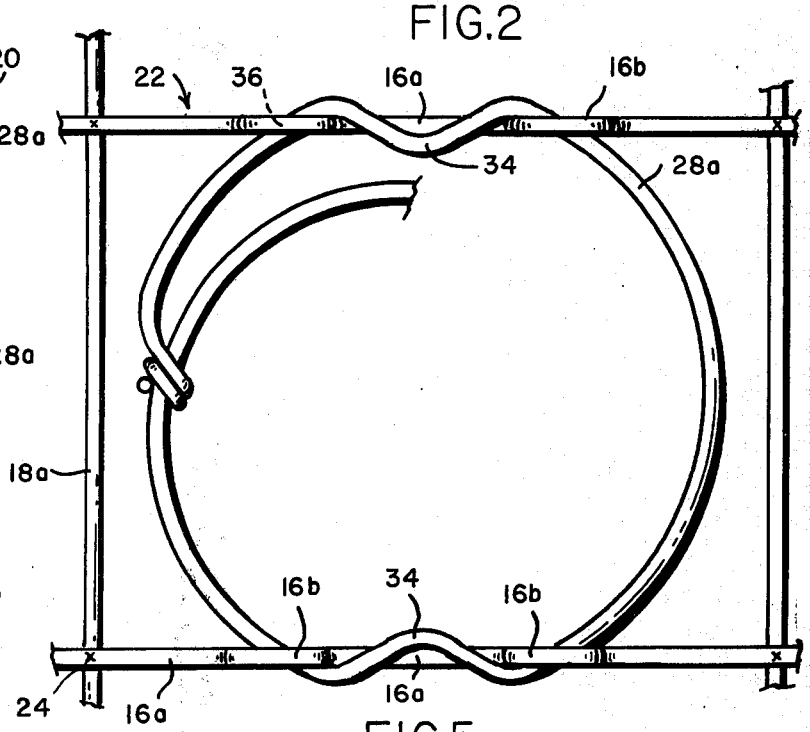
FIG. 5 is a plan view of a single seat.
Figure 6:
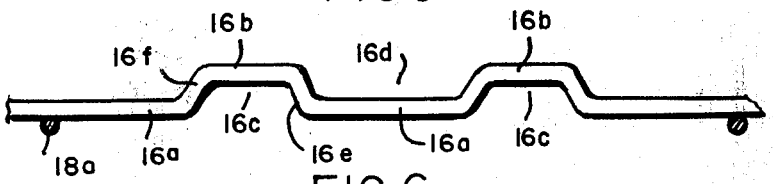
FIG. 6 is an elevation of the seat shown in FIG. 5 without the attached coil spring.
Figure 8:
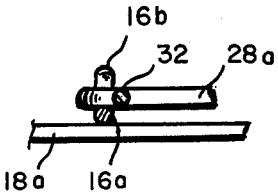
FIG. 8 is a fragmentary section taken on the line 8-8 of FIG. 7.
Figure 7:
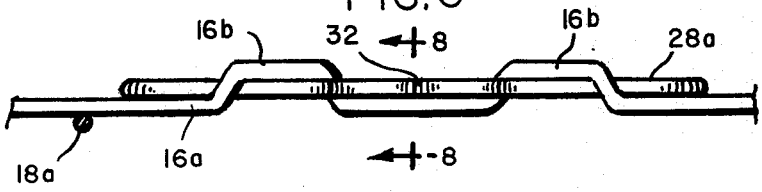
FIG. 7 is a plan view of a single seat with the coiled spring attached.

The coil springs 20 have large end loops $28^a$ at one end, a smaller end loops $28^b$ at the other end and a plurality of convolutions 30 of decreasing diameter between the end loops. The upper end loop $28^a$ as shown in FIG. 3 contain diametrically disposed deviations 32—32 in the form of inwardly bent crimped portions 34—34. The distance between the inner extremities of the crimped portions is less than the distance between the wire portions $16^a$—$16^a$.

In accordance with the invention the frame comprising the border wire, spaced pairs of longitudinally and transversely extending wires and the coils are assembled by placing the upper end loop $28^a$ against the underside of the frame at a seat and then either by distending the upper end loop of the coil or by displacing the wire sections $16^a$—$16^a$ toward each other introducing the wire sections $16^a$—$16^a$ beneath the inwardly bent portions 34—34 of the end loop of the coil whereupon the end loop is released so that it returns to its initial shape or the wires are released to allow them to go back to their initial spacing. The result is to lock the end loop of the coil to the frame in which position arcuate portions 36—36 of the normal radius of curvature of the end loop extend thru the openings $16^c$—$16^c$ in engagement with the undersides of the downwardly facing openings $16^b$—$16^b$ from the inner side of the wires outwardly and the inwardly bent portions 34—34 extends inwardly thru the upwardly facing opening 16d from the outside in engagement with the undeviated portions of the wires $16^a$ in contrast to Applicant's prior structure where the engagement of the bent portions with the wires was limited. The structure as herein illustrated provides for limiting upward movement of the coil relative to the frame by engagement of the end loop with the wire portions $16^b$—$16^b$, downward movement of the coil by engagement of the end loop with the wire portion 16a and lateral movement in either direction by engagement of the arcuate portions 36—36 at the inner side with the vertical portions 16e and at the outer side by the vertical portions $22^f$—$22^f$ and, further by engagement of the legs of the bent portions 32 with the inner sides of the vertical portions $16^e$—$16^e$. The result is that the coil is prevented from tilting and twisting under the most severe conditions.

It is to be understood that the deviations in the wires may be formed in the longitudinally extending wires or the transversely extending wires or both, that the distance between both the longitudinally extending wires and the transversely extending wires can be less than the diameters of the end loops of the coils and that the end loops of the coil may be provided with bent portions at right angularly disposed diameters so as to be able to be locked at four points to the four wire sections forming each seat.

It should be understood that the present disclosure is for the purpose of illustration only and includes all modifications or improvements which fall within the scope of the appended claims.

I claim:

1. A spring assembly comprising a border wire to which are attached transversely and longitudinally extending pairs of crossing wires welded at their intersections, said pairs of crossing wires defining seats for attachment thereto of the end loops of coil springs characterized in that at least two opposed wires of the seats contain longitudinally spaced deviations in planes perpendicular to the seats which define in conjunction with the portions of the wire therebetween vertically spaced and longitudinally spaced bearing surfaces and the end loops contain diametrically disposed deviations of such configuration as to require relative deformation of the wires of the seat and the end loops to be interengaged and to become locked by restoration to their undeformed state and wherein the deviations in the end loops lie in the planes of the end loops such that when the end loops are sprung into engagement with the wires, the arcuate portions of the end loops pass through the deviations in the wires from one side and the deviating portions of the end loops pass between the deviations in the wires from the other side in engagement with the vertically and longitudinally spaced bearing surfaces provided by said deviating and nondeviating portions of the wires so as to prevent relative movement of the end loops perpendicularly and parallel to the plane of the grid.

2. A spring assembly according to claim 1, wherein the distance between the wires containing the deviations is less than the diameters of the end loops and the distances between the deviating portions of the end loops are less than the distance between the wires.

3. A spring assembly according to claim 1, wherein the displacement of the deviating portions of the wires is upwardly with respect to the plane of the wires.

4. A spring assembly according to claim 1, wherein the displacement of the deviating portions of the wires is upwardly with respect to the plane of the wires an amount corresponding to the thickness of the wires of the end loops.

5. A spring assembly according to claim 1, wherein the deviations in the wires comprise longitudinally spaced upwardly displaced portions defining in a plane perpendicular to the plane of the wires, two downwardly facing openings and an upwardly facing opening between the downwardly facing openings.

6. A spring assembly according to claim 1, wherein all of the wires in one direction lie in a plane above the wires in the other direction and the deviations are in the wires in the one direction such that the end loops of the coils lie in a plane above the wires in the other direction.

7. A spring assembly according to claim 1, wherein the deviations in the wires are such that the end loops when seated lie in a plane above plane of the wires containing the deviations.

8. A grid for a spring assembly comprising a border wire of rectangular configuration having spaced parallel sides and ends and pairs of spaced, parallel, longitudinally and transversely extending crossing wires attached at their ends to the border wire and welded at their intersections, said crossing wires defining substantially rectangular seats and one pair of opposing wires at each seat containing deviating portions in planes perpendicular to the plane of the grid which define vertically and longitudinally spaced bearing surfaces.

* * * * *